US009033689B2

(12) United States Patent
Ginies et al.

(10) Patent No.: US 9,033,689 B2
(45) Date of Patent: May 19, 2015

(54) SCROLL REFRIGERATION COMPRESSOR INCLUDING HEAT SHIELD, BYPASS PASSAGE, AND BYPASS VALVE

(75) Inventors: Pierre Ginies, Sathonay Village (FR); Christophe Ancel, Villefranche sur Saone (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 19 days.

(21) Appl. No.: 13/994,338

(22) PCT Filed: Nov. 28, 2011

(86) PCT No.: PCT/FR2011/052778

§ 371 (c)(1),
(2), (4) Date: Jul. 24, 2013

(87) PCT Pub. No.: WO2012/080610

PCT Pub. Date: Jun. 21, 2012

(65) Prior Publication Data

US 2013/0302197 A1 Nov. 14, 2013

(30) Foreign Application Priority Data

Dec. 14, 2010 (FR) ..... 10 60470

(51) Int. Cl.
*F03C 2/00* (2006.01)
*F03C 4/00* (2006.01)
(Continued)

(52) U.S. Cl.
CPC ..... *F04C 29/04* (2013.01); *F04C 18/0215* (2013.01); *F04C 18/0253* (2013.01); *F04C18/0261* (2013.01); *F04C 23/008* (2013.01); *F04C 28/06* (2013.01); *F04C 28/26* (2013.01); *F04C 28/28* (2013.01)

(58) Field of Classification Search
USPC ..... 418/55.1–55.6, 57, 270, 15; 417/307–308, 310, 410.5
See application file for complete search history.

(56) References Cited

U.S. PATENT DOCUMENTS 5,516,267 A 5/1996 Ikeda et al.
6,287,089 B1 9/2001 Williams et al.
(Continued)

FOREIGN PATENT DOCUMENTS

FR 2 919 688 A1 2/2009
FR 2 919 689 A1 2/2009

OTHER PUBLICATIONS

Jul. 26, 2011 Search Report issued in French Application No. 1060470.
(Continued)

*Primary Examiner* — Theresa Trieu
(74) *Attorney, Agent, or Firm* — Oliff PLC

(57) ABSTRACT

The scroll refrigeration compressor includes a sealed casing, stationary and moving volutes including spiral wraps engaged in one another and defining the variable-volume compression chambers, a delivery chamber defined by the plate of the stationary volute and the sealed casing, a heat shield disposed in the delivery chamber and dividing the delivery chamber into a first volume defined by the plate of the stationary volute and the heat shield and a second volume defined by the heat shield and the sealed casing, and at least one flow passage arranged to communicate the first and second volumes. The compressor further includes at least one bypass passage arranged to communicate the first volume with an intermediate compression chamber, and at least one bypass valve disposed in the first volume and movable between closing and opening positions for closing and opening the corresponding bypass passage.

9 Claims, 2 Drawing Sheets

(51) Int. Cl.

| | |
|---|---|
| ***F04C 2/00*** | (2006.01) |
| ***F04C 29/04*** | (2006.01) |
| ***F04C 18/02*** | (2006.01) |
| ***F04C 23/00*** | (2006.01) |
| ***F04C 28/26*** | (2006.01) |
| ***F04C 28/28*** | (2006.01) |
| *F04C 28/06* | (2006.01) |

(56) References Cited

U.S. PATENT DOCUMENTS

| | | | |
|---|---|---|---|
| 2003/0099564 | A1 | 5/2003 | Witham et al. |
| 2009/0041603 | A1 | 2/2009 | Ginies et al. |

OTHER PUBLICATIONS

May 8, 2013 International Search Report issued in International Application No. PCT/FR2011/052778 (with translation).

SCROLL REFRIGERATION COMPRESSOR INCLUDING HEAT SHIELD, BYPASS PASSAGE, AND BYPASS VALVE

BACKGROUND

The present invention relates to a scroll refrigeration compressor.

In a known manner, a scroll refrigeration compressor comprises a first stationary volute and a second volute following an orbital movement, each volute including a plate from which a spiral wrap extends, the two spiral wraps being engaged in one another and defining variable volume compression chambers, the compression chambers having a volume that decreases gradually from the outside, where refrigerant is admitted, toward the inside.

Thus, during the orbital movement of the first volute, the refrigerant is compressed due to the decrease in the volume of the compression chambers and conveyed to the center of the first and second volutes. The compressed and heated refrigerant leaves from the central part toward a delivery chamber through a delivery conduit formed in the central part of the first volute.

SUMMARY

One drawback of this type of compressor lies in the fact that the compressed refrigerant that is delivered in the delivery chamber heats the plate of the stationary volute, which, by conduction, heats the refrigerant gas to be compressed.

This heating of the refrigerant gas causes an increase in the temperature and enthalpy of said gas, as well as a decrease in its density. This decrease in the density of the refrigerant gas to be compressed causes a decrease in the mass of gas compressed by the compressor, and therefore a reduced heat energy, for a same swept gas volume. Due to the intrinsic properties of the refrigerant gas (the isentropic slope in the dry vapor domain evolves with the overheating), the compression work per unit of mass increases following this overheating of the gas to be compressed, and as a result, the energy output of the compressor is reduced. This thereby results in decreased performance of the compressor.

In order to improve the performance of such a compressor, it is known, as described in document U.S. Pat. No. 6,287,089, to equip such a compressor with a heat shield in the form of a plate positioned in the delivery chamber and mounted on the plate of the fixed volute, the heat shield dividing the delivery chamber into a first volume delimited by the plate of the stationary volute and the heat shield and a second volume delimited by the heat shield and the sealed casing.

The presence of such a heat shield prevents excessive heating of the refrigerant gas to be compressed by the compressed refrigerant gas, which makes it possible to improve the energy output of the compressor.

However, when the compressed refrigerant fluid flows in the second volume, droplets of oil fall by gravity on the heat shield and flow on the latter until they reach a peripheral area of the second volume where the oil is trapped due to the fact that the stationary volute is sealably fastened on the sealed casing. However, given that the speeds of the compressed refrigerant fluid are generally low in the peripheral area of the second volume, a significant quantity of oil may build up in the second volume, which may deteriorate the performance of the compressor.

The present invention aims to resolve this drawback.

The technical problem at the base of the invention consists of providing a scroll refrigeration compressor that has a simple, cost-effective and compact structure, and that makes it possible to improve the performance of the compressor.

To that end, the present invention relates to a scroll refrigeration compressor comprising:

- a sealed casing;
- a stationary volute sealably fixed on the sealed casing and a moving volute following an orbital movement, each volute including a plate from which a spiral wrap extends, the spiral wraps of the stationary and moving volutes being engaged in one another and defining the variable-volume compression chambers,
- a delivery chamber defined by the plate of the stationary volute and the sealed casing,
- a plate-shape heat shield disposed in the delivery chamber and mounted on the plate of the stationary volute, the heat shield dividing the delivery chamber into a first volume defined by the plate of the stationary volute and the heat shield and a second volume defined by the heat shield and the sealed casing,
- at least one flow passage arranged to communicate the first and second volumes, wherein the flow passage is at least partially defined by an inner wall of the sealed casing and an outer peripheral edge of the heat shield, and the compressor further comprises:

- at least one bypass passage formed in the plate of the stationary volute and arranged to communicate the first volume with an intermediate compression chamber, and
- at least one bypass valve which is disposed in the first volume and associated with a bypass passage, each bypass valve associated with a bypass passage being movable between closing and opening positions for closing and opening the corresponding bypass passage, and being designed to be moved in the opening position thereof when the pressure in the intermediate compression chamber in which the corresponding bypass passage emerges exceeds the pressure in the delivery chamber by a predetermined value.

The presence of such a bypass passage and such a bypass valve makes it possible to ensure, under non-optimal operating conditions of the compressor allowing opening of said bypass valve, for example during the startup or deicing phases of the compressor in which the pressure differences between the delivery and suction pressures are small, the flow of part of the compressed refrigerant fluid through said bypass passage and in the first volume, which causes foaming of the oil accumulated in the first volume and trapping of oil droplets in the refrigerant fluid. As a result, at least part of the oil accumulated in the first volume is captured by the refrigerant fluid flowing through the bypass passage and reintroduced into the circuit with which the compressor is integrated.

It must be noted that, under the non-optimal operating conditions of the compressor allowing opening of the bypass valve, the delivery temperature of the refrigerant fluid flowing through the bypass passage is low. This, added to the fact that only a small part of the compressed refrigerant fluid flows through the bypass passage, results in limiting the reheating of the plate of the stationary volute by the refrigerant fluid flowing through the bypass passage, and the impact of the heat transfer due to that new circulation of gas on the energy output of the compressor is therefore negligible.

Furthermore, under optimal operating conditions of the compressor, the bypass valve is kept in the closing position. As a result, all of the compressed refrigerant fluid, which under these operating conditions has a high delivery temperature, flows directly into the second volume and does not affect the energy output of the compressor.

The intermediate compression chamber refers to a compression chamber having a pressure comprised between the pressure of the first compression chamber "said to be the displacement pressure" and the pressure of the last compression chamber emerging in the delivery conduit.

According to one embodiment of the invention, the compressor comprises a plurality of bypass passages and a plurality of bypass valves positioned in the first volume and each associated with a bypass passage.

Advantageously, the flow passage has a cross-section adapted such that the oil driving speeds are sufficient to ensure proper operation of the compressor. Furthermore, this flow passage may have a non-constant cross-section along the outer periphery of the heat shield.

Advantageously, the outer peripheral edge of the heat shield is situated at a distance from the plate of the stationary volute.

Advantageously, each bypass valve is mounted on the surface of the plate of the stationary volute turned toward the heat shield.

Preferably, the compressor comprises at least one bypass valve made in the form of a strip elastically deformable between closing and opening positions for closing and opening the corresponding bypass passage.

Advantageously, each bypass passage comprises a first end emerging in the corresponding intermediate compression chamber, and a second end emerging in the first volume.

Preferably, each bypass valve is arranged to seal the second end of the corresponding bypass passage when it is in its closing position.

According to one embodiment of the invention, the plate of the stationary volute has an outer peripheral wall sealably fixed on the inner wall of the sealed casing.

According to one advantageous feature of the invention, the surface of the plate of the stationary volute turned toward the heat shield has at least one surface inclined from the inside toward the outside and from the heat shield toward the moving volute, and at least one bypass valve is mounted on said inclined surface.

Preferably, the compressor comprises:

- a delivery conduit, formed in the central part of the plate of the stationary volute, comprising a first end emerging in a central compression chamber and a second end designed to communicate with the delivery chamber,
- an anti-return device mounted on the plate of the stationary volute at the second end of the delivery conduit, the anti-return device comprising:
  - at least one delivery opening arranged to communicate the delivery conduit and the delivery chamber,
  - a valve seat surrounding the delivery opening, and
  - a delivery valve movable between a closing position in which the delivery valve bears against the valve seat and seals the delivery opening, and an open position in which the delivery valve is distant from the valve seat and frees the delivery opening, the delivery valve being designed to be moved into its open position when the pressure in the delivery conduit exceeds the pressure in the delivery chamber by a predetermined value.

Advantageously, the heat shield is mounted on the plate of the stationary volute so as to surround the delivery conduit.

Preferably, the anti-return device includes a valve plate comprising at least one delivery opening, and on which the valve seat is formed.

According to one preferred embodiment of the invention, the compressor comprises abutment means arranged to limit the amplitude of movement of the bypass valve and/or the delivery valve toward the open position thereof.

In any case, the invention will be well understood using the following description done in reference to the appended diagrammatic drawing showing, as a non-limiting example, one embodiment of this compressor.

DETAILED DESCRIPTION OF THE EMBODIMENTS

In the following description, the same elements are designated using the same references in the different embodiments.

Figure 1:
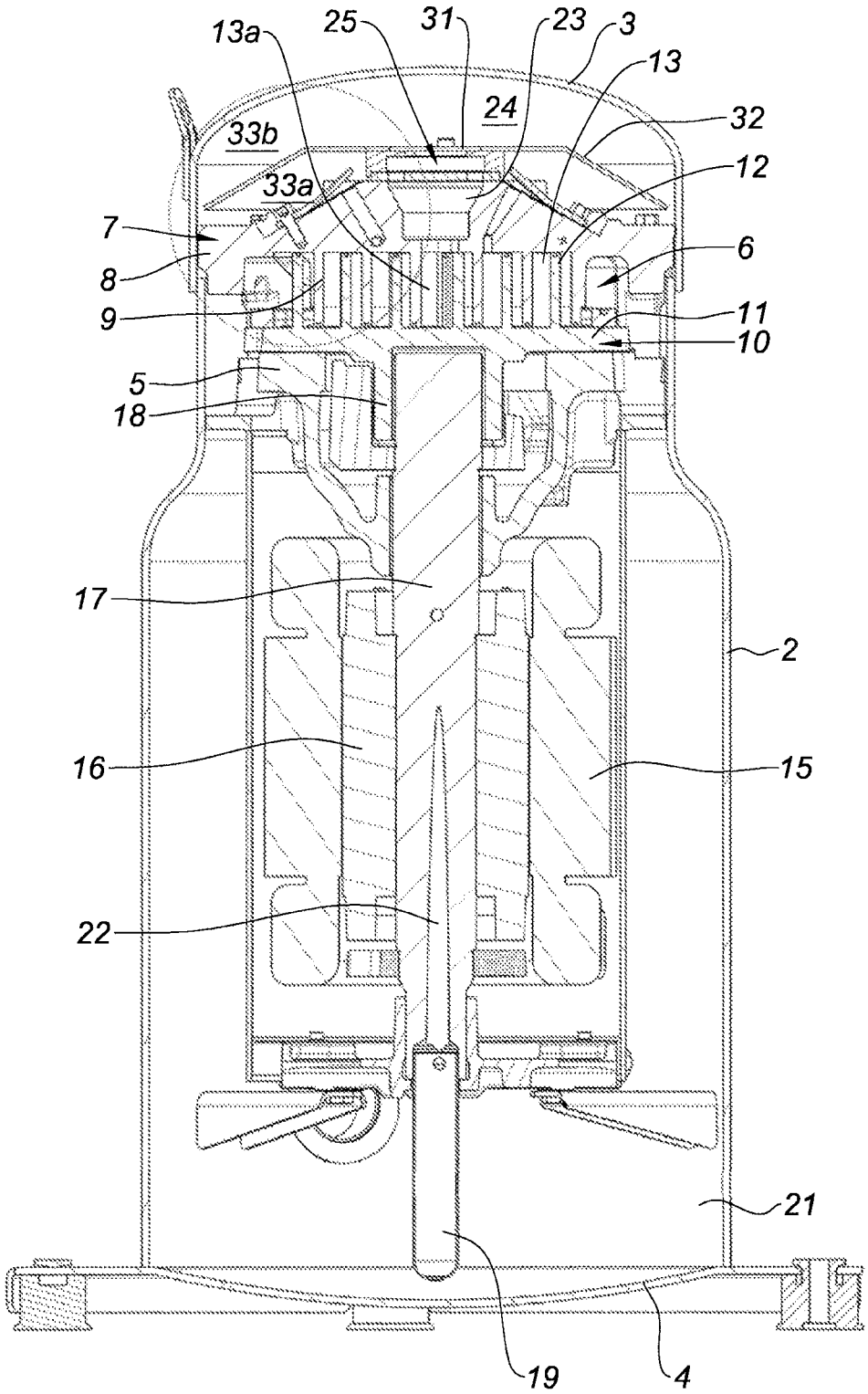
FIG. 1 is a longitudinal cross-sectional view of a compressor according to the present invention.

FIG. 1 describes a scroll refrigeration compressor in a vertical position. However, the compressor according to the invention may be in an inclined position or horizontal position, without the structure being significantly modified.

The compressor shown in FIG. 1 comprises a sealed casing delimited by a shell 2 whereof the upper and lower ends are respectively closed by a cover 3 and a base 4. The assembly of this casing may in particular be done using weld seams.

The intermediate part of the compressor is occupied by a body 5 that is used to mount a compression stage 6. This compression stage 6 comprises a stationary volute 7 including a plate 8 from which a stationary spiral wrap 9 extends turned downward, and a moving volute 10 including a plate 11 bearing against the body 5 and from which a spiral wrap 12 extends turned upward. The two spiral wraps 9 and 12 of the two volutes penetrate one another to form variable-volume compression chambers 13.

The plate 8 of the stationary volute 7 has an outer peripheral wall sealably fastened on the inner wall of the sealed casing, and more particularly on the inner wall of the cover 3. The plate 8 of the stationary volute 7 thus delimits two volumes, a suction volume situated below the plate of the stationary volute 7, and a compression volume positioned above the latter.

The shell 2 comprises a refrigerant gas inlet (not shown in the figures) emerging in the suction volume to bring the gas to the compressor.

The compressor comprises an electric motor that is disposed in the suction volume. The electric motor comprises a stator 15, at the center of which a rotor 16 is disposed. The rotor 16 is secured to a drive shaft 17 whereof the upper end is off-centered like a crankshaft. This upper part is engaged in a sleeve-forming part 18, included by the moving volute 10. During rotation thereof by the motor, the drive shaft 17 drives the moving volute 10 in an orbital movement.

The lower end of the drive shaft 17 drives an oil pump 19 supplying, from oil contained in the oil sump 21 defined by the base 4, an oil supply conduit 22 formed in the central part of the drive shaft.

The compressor further comprises a delivery conduit 23 formed in the central part of the stationary volute 7. The delivery conduit 23 comprises a first end emerging in the central compression chamber 13*a* and a second end designed to communicate with a high-pressure delivery chamber 24 defined by the casing of the compressor and the plate 8 of the stationary volute 7.

The compressor comprises an anti-return device 25. The anti-return device 25 includes a valve plate 26 in the form of a disc mounted on the plate 8 of the stationary volute 7 of the second end of the delivery conduit 23. The valve plate 26 comprises a plurality of delivery openings 27 arranged to communicate the delivery conduit 23 and the delivery chamber 24, and a valve seat 28 formed on the surface of the valve plate 26 opposite the stationary volute 7 and surrounding the delivery openings 27.

The anti-return device 25 also includes a delivery valve 29 movable between a closing position, in which the delivery valve 29 bears against the valve seat 28 and covers the delivery openings 27, and an open position, in which the delivery valve 29 is distant from the valve seat 28 and frees the delivery openings 27. The delivery valve 29 is designed to be moved from its open position when the pressure in the delivery conduit 23 exceeds the pressure in the delivery chamber 24 by a predetermined value substantially corresponding to the adjustment pressure of the delivery valve 29. The delivery valve 29 is for example substantially annular.

The compressor also comprises a retaining plate 30 mounted on the valve plate 26 and designed to serve as an abutment for the delivery valve 29 when it is in its open position. The retaining plate 30 comprises at least one passage opening 31 arranged to allow a flow of refrigerant fluid from the delivery openings 27 toward the delivery chamber 24.

The compressor further comprises a heat shield 32 in the form of a plate positioned in the delivery chamber 24 and mounted on the plate 8 of the stationary volute 7 so as to surround the delivery conduit 23. The heat shield 32 divides the delivery chamber 24 into a first volume 33*a* defined by the plate 8 of the stationary volute 7 and the heat shield 32 and a second volume 33*b* defined by the heat shield 32 and the sealed casing. The heat shield 32 includes a first portion 32*a* extending substantially perpendicular to the longitudinal axis of the compressor and a second portion 32*b* extending the first portion and extending in an inclined manner with respect to the first portion 32*a*.

The compressor also comprises at least one flow passage 34 arranged to communicate the first and second volumes 33*a*, 33*b*. The flow passage 34 is advantageously annular and is defined by the inner wall of the sealed casing, the outer peripheral edge of the heat shield 32 and the plate of the stationary volute. It must be noted that the dimensions of the flow passage 34 may be variable along the outer periphery of the heat shield 32.

The compressor further comprises two bypass passages 35 arranged respectively to communicate the first volume 33*a* with an intermediate compression chamber. Each bypass passage 35 is formed by a bypass channel formed in the plate 8 of the stationary volute 7 and comprising a first end emerging in an intermediate compression chamber 13*b* and a second end emerging in the surface of the plate 8 of the stationary volute 7 turned toward the side of the valve plate 26.

The compressor additionally comprises two bypass valves 36 disposed in the first volume 33*a*. Each bypass valve 36 is movable between a closing position for closing one of the bypass passages 35, and an open position for opening said bypass passage. Each bypass valve 36 is designed to be moved in its open position when the pressure in the intermediate compression chamber 13*b* in which the corresponding bypass passage emerges exceeds the pressure in the delivery chamber 24 by a predetermined value substantially corresponding to the adjustment pressure of said bypass valve 36.

Each bypass valve 36 is mounted on the surface of the plate 8 of the stationary volute 7 turned toward the heat shield 32, and is arranged to seal the second end of the corresponding bypass passage 35 when it is in its closing position.

Furthermore, each bypass valve 36 is advantageously made in the form of a strip elastically deformable between a closing position for closing the corresponding bypass passage and a open position for opening the corresponding bypass passage.

The compressor also comprises a retaining plate 37 associated with each bypass valve 36 and designed to serve as an abutment for the corresponding bypass valve 36 when it is in its open position. Advantageously, each retaining plate 37 is fixed by screwing on the plate of the stationary volute.

The operation of the scroll compressor will now be described.

When the scroll compressor according to the invention is started, the moving volute 10 is driven by the drive shaft 17 in an orbital movement, this movement of the moving volute causing an intake and compression of refrigerant fluid in the variable-volume compression chambers 13.

Under optimal operating conditions, each bypass valve 36 is subject, on the face thereof turned toward the plate 8 of the stationary volute 7, to a pressure lower than the pressure in the delivery chamber 24. Thus, said bypass valves 36 are kept in their closing position and consequently isolate the intermediate compression chambers 13*b* in which the corresponding bypass passages 35 emerge.

As a result, all of the refrigerant fluid compressed in the compression chambers 13 reaches the center of the spiral wraps and escapes through the delivery conduit 23 toward the delivery chamber 24 by moving the delivery valve 29 into the open position thereof, and lastly by flowing axially through the delivery openings 27 and the passage openings 31.

Under non-optimal operating conditions, for example seasonally, during startup, or during deicing of the compressor, each bypass valve 36 may be subject, on the face thereof turned toward the plate 8 of the stationary volute 7, to a pressure higher than the pressure in the delivery chamber 24. In that scenario, said bypass valves 36 deform elastically toward the open position thereof and communicate the intermediate compression chambers 13*b* in which the corresponding bypass passages 35 emerge with the first volume 33*a*. This thereby results in a delivery to the first volume 33*a* of part of the refrigerant fluid comprised in the intermediate compression chambers 13*b* in which the bypass passages 35 emerge before that part of the refrigerant fluid reaches the center of the spiral wraps.

These arrangements make it possible to ensure that the surface of the oil accumulated in the first volume 33*a* is passed over by the refrigerant fluid, or even to ensure blowing of part of the oil accumulated in the first volume through the flow passage 34, causing an increase in the oil level in the refrigerant fluid. As a result, part of the oil accumulated in the first volume 33*a* is evacuated toward the delivery opening (not shown in the figures) of the compressor by means of the refrigerant fluid.

Figure 2:
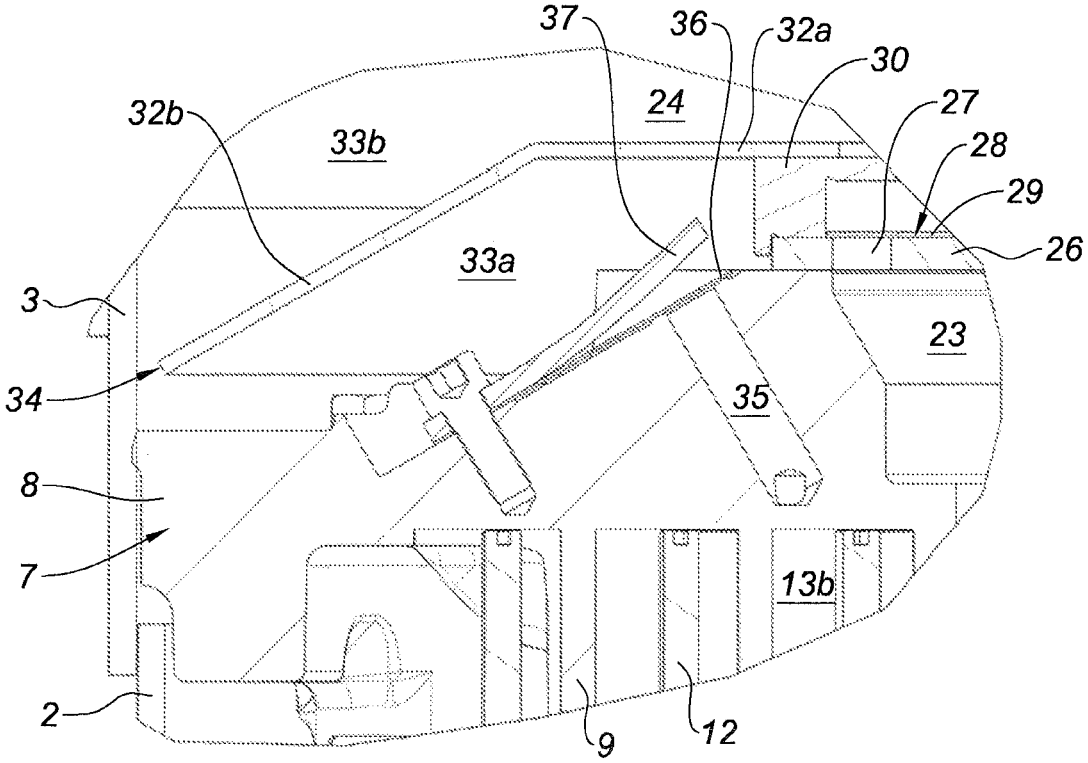
FIG. 2 is an enlarged partial cross-sectional view of the compressor of FIG. 1.
Figure 3:
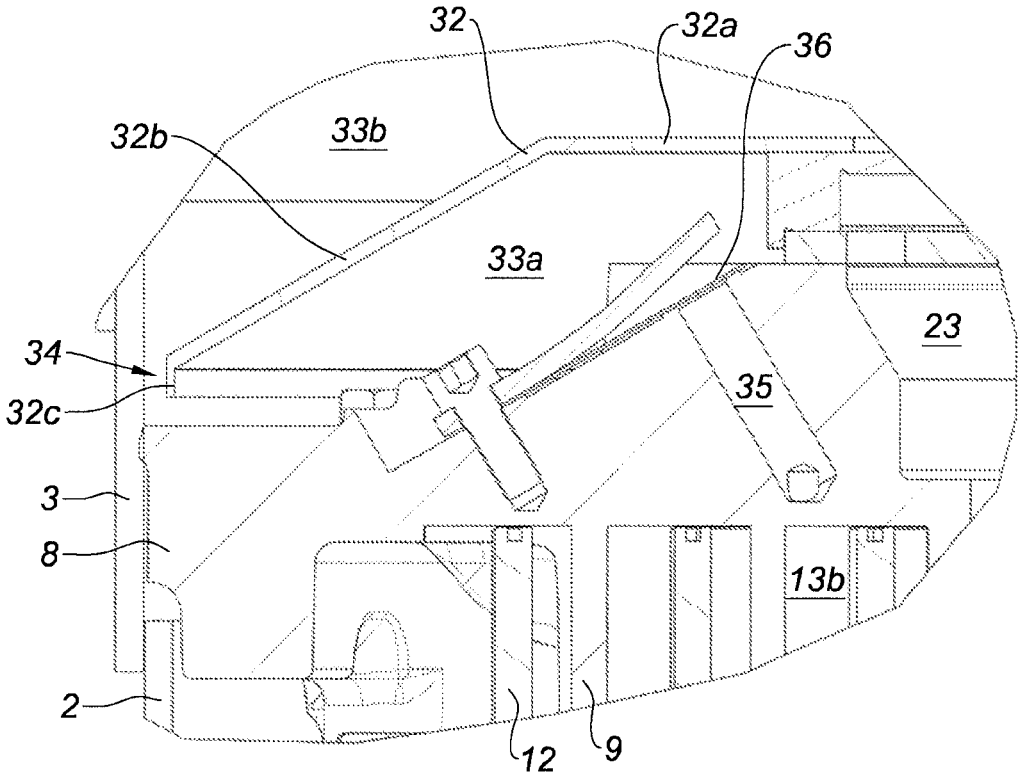
FIG. 3 is an enlarged partial cross-sectional view of a compressor according to one alternative embodiment of the invention.

FIG. 3 shows an alternative embodiment that differs from that shown in FIGS. 1 and 2 only in that the heat shield 32 has a third portion 32*c* extending the second portion 32*b* and extending substantially parallel to the longitudinal axis of the compressor. These arrangements make it possible to reduce the distance separating the heat shield and the plate of the stationary volute so as to favor the ejection of an oil mist through the flow passage 34.

The invention is of course not limited solely to the embodiment of this compressor described above is an example, but on the contrary encompasses all alternative embodiments thereof.

The invention claimed is:

1. A scroll refrigeration compressor comprising:

a sealed casing;

a stationary volute sealably fixed on the sealed casing and a moving volute following an orbital movement, each of the volutes including a plate from which a spiral wrap extends, the spiral wraps of the stationary and moving volutes being engaged in one another and defining variable-volume compression chambers;

a delivery chamber defined by the plate of the stationary volute and the sealed casing;

a heat shield having a plate-shape and being disposed in the delivery chamber and mounted on the plate of the stationary volute, the heat shield dividing the delivery chamber into a first volume defined by the plate of the stationary volute and the heat shield and a second volume defined by the heat shield and the sealed casing, and the heat shield including: (i) a first portion extending substantially perpendicular to a longitudinal axis of the compressor, (ii) a second portion extending from the first portion and in an inclined manner with respect to the first portion, and (iii) a third portion extending from the second portion substantially parallel to the longitudinal axis of the compressor:

at least one flow passage arranged to communicate the first and second volumes, the at least one flow passage being at least partially defined by an inner wall of the sealed casing and an outer peripheral edge of the heat shield;

at least one bypass passage formed in the plate of the stationary volute and arranged to communicate the first volume with an intermediate compression chamber; and at least one bypass valve that is disposed in the first volume and associated with a said at least one bypass passage, each of the at least one bypass valves being movable between closing and opening positions for closing and opening the corresponding bypass passage, and being configured to be moved into the opening position when pressure in the intermediate compression chamber in which the corresponding bypass passage emerges exceeds pressure in the delivery chamber by a predetermined value.

2. The compressor according to claim 1, wherein each of the at least one bypass valves is mounted on a surface of the plate of the stationary volute turned toward the heat shield.

3. The compressor according to claim 1, wherein at least one of the at least one bypass valves is made in the form of a strip elastically deformable between the closing and the opening positions for closing and opening the corresponding bypass passage.

4. The compressor according to claim 1, wherein each of the at least one bypass passages comprises a first end emerging in the corresponding intermediate compression chamber, and a second end emerging in the first volume.

5. The compressor according to claim 4, wherein each of the at least one bypass valves is arranged to close the second end of the corresponding bypass passage when the valve is in its closing position.

6. The compressor according to claim 1, wherein the plate of the stationary volute has an outer peripheral wall sealably fixed on the inner wall of the sealed casing.

7. The compressor according to claim 1, wherein a surface of the plate of the stationary volute turned toward the heat shield has at least one surface inclined from the inside toward the outside and from the heat shield toward the moving volute, and at least one of the at least one bypass valves is mounted on the at least one inclined surface.

8. The compressor according to claim 1, wherein the compressor further comprises:

a delivery conduit, formed in a central part of the plate of the stationary volute, comprising a first end emerging in a central compression chamber and a second end configured to communicate with the delivery chamber, an anti-return device mounted on the plate of the stationary volute at the second end of the delivery conduit, the anti-return device comprising:

at least one delivery opening arranged to communicate the delivery conduit and the delivery chamber, a valve seat surrounding the delivery opening, and a delivery valve movable between a closing position in which the delivery valve bears against the valve seat and closes the delivery opening, and an open position in which the delivery valve is distant from the valve seat and frees the delivery opening, the delivery valve being configured to be moved into its open position when pressure in the delivery conduit exceeds pressure in the delivery chamber by a predetermined value.

9. The compressor according to claim 8, wherein the heat shield is mounted on the plate of the stationary volute so as to surround the delivery conduit.

* * * * *